United States Patent [19]

Noguchi

[11] Patent Number: 4,562,521

[45] Date of Patent: Dec. 31, 1985

[54] LANTERN TYPE ELECTRIC LAMP

[76] Inventor: Isamu Noguchi, 333 E. 69th St., New York, N.Y. 10021

[21] Appl. No.: 638,022

[22] Filed: Aug. 6, 1984

[51] Int. Cl.[4] ..... F21S 1/12

[52] U.S. Cl. ..... 362/433; 362/414; 362/352; 362/358; 362/806

[58] Field of Search ..... 362/806, 414, 417, 433, 362/434, 351, 352, 358

[56] References Cited

U.S. PATENT DOCUMENTS

| | | | |
|---|---|---|---|
| 12,646 | 4/1855 | Wilhelm | 362/434 |
| 732,806 | 7/1903 | Wolfert | 362/806 |
| 741,293 | 10/1903 | Barnes | 362/806 |
| 1,430,941 | 10/1922 | Cave | 362/434 |
| 2,754,412 | 7/1956 | Noguchi | 362/358 |
| 3,041,446 | 6/1962 | Erlewine et al. | 362/806 |
| 3,194,959 | 7/1965 | Bashaw et al. | 362/358 |
| 3,654,052 | 4/1972 | Rye | 362/351 |
| 3,946,221 | 3/1976 | Gandini | 362/433 |
| 4,167,034 | 9/1979 | Noguchi | 362/434 |
| 4,229,784 | 10/1980 | Noguchi | 362/417 |

FOREIGN PATENT DOCUMENTS

| | | | |
|---|---|---|---|
| 1162351 | 8/1958 | France | 362/806 |

*Primary Examiner*—Ira S. Lazarus
*Attorney, Agent, or Firm*—Michael Ebert

[57] ABSTRACT

A lamp stand adapted to support in a fully expanded state a collapsible oriental lantern formed by an open-ended translucent shell on a floor or table surface. The upper opening of the shell is bounded by a top rib to which is attached a spider whose center hub has a hole therein, the lower opening being bounded by a bottom rib provided with tie strings or other leg connectors. The stand includes a raised mounting plate supporting a lamp socket and a harp from which upwardly extends a vertical rod that passes through the hole in the spider hub. The rod has an elastic collar thereon which is axially shiftable to a point under the hub to maintain the upper end of the lantern at this level, which print depends on the length of the lantern. Depending from the mounting plate is an array of legs each having an outwardly sloped upper section and a straight lower section whose foot rests on the surface. The bottom rib of the lantern rests on the sloped upper section of the legs at a level thereon determined by the size of the lower opening of the lantern and is secured thereto by the leg connectors.

9 Claims, 13 Drawing Figures

Fig. 1.
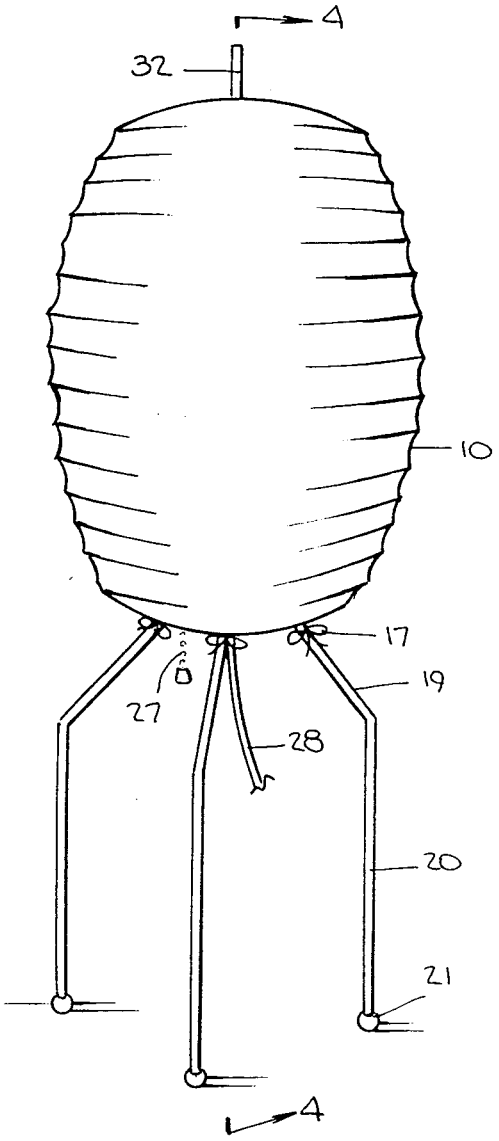
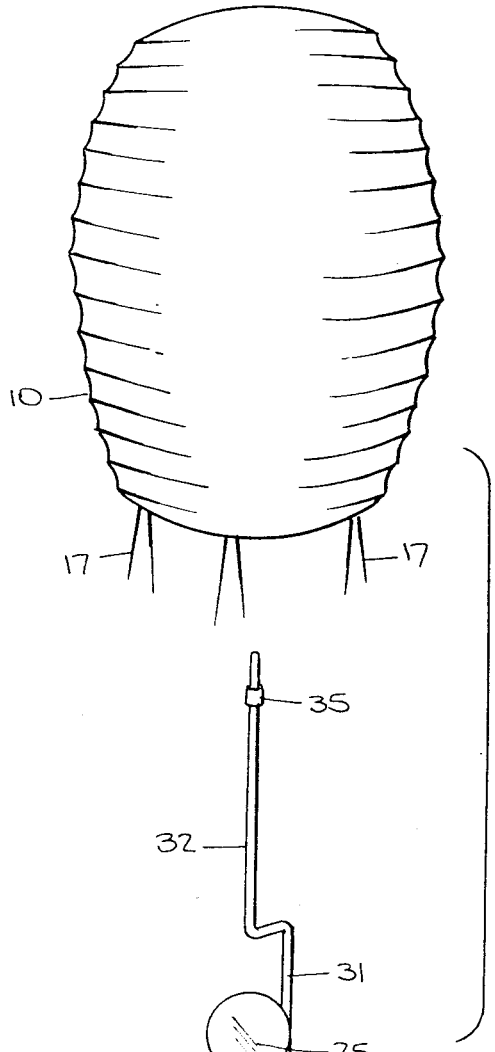
Fig. 2.
Fig. 3.
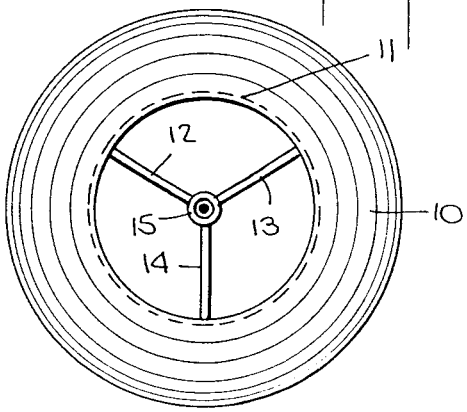

32
25
26
31
23
30
33
19
22
18
29
34

31
26
7
23
30
7
22
29
18
28
19

31
26
30
33
29
23
34
28
24
18
23
22
19

LANTERN TYPE ELECTRIC LAMP

BACKGROUND OF INVENTION

1. Field of Invention

This invention relates to table and floor lamps whose shade is in the form of a collapsible oriental lantern, and more particularly to lamps of this type which include a highly stable stand capable of supporting lanterns of different configurations.

2. Prior Art

As originally conceived by the ancient Romans, the lantern consisted of side panels of thin, translucent horn material that surrounded an oil lamp to shield it against wind and rain. The Roman lantern was revived in the middle ages and was then furnished with candles. The traditional Chinese or Japanese lantern which is still in use and is hereinafter referred to as an oriental lantern, is composed of a thin rice paper or fabric shell of spheroidal form having a reinforcing spiral embedded therein, polar openings of the shell being bordered by circular ribs.

The conventional lampstand arrangement is designed to support the typical non-collapsible lampshade which includes a spider whose arms radiate from a central hub having a hole therein into which is inserted the stud of the lamp harp. This lampstand is ill suited for use with a collapsible oriental lantern as the lampshade; for with this stand, one cannot subject the lantern shell to tension and to fully expand and maintain its proper form. While it is known to install a wire stretcher within an oriental lantern to tension the shell, such stretchers are not usuable when the lantern is mounted on a lampstand harp.

Of prior art interest is my prior U.S. Pat. No. 4,167,034 in which an oriental lantern is mounted on a lampstand, the top end of the lantern being supported on a rod extending upwardly from the lamp harp and the lower end being supported on a rod extending downwardly from the harp. The lower rod is anchored in a base which rests on the floor or table surface.

My prior lampstand arrangement makes it possible to support lanterns thereon of different lengths. But the structure of the lampstand is such that the lantern, the lamp socket and the harp are all held at an elevated position by a single rod acting as a leg anchored in the base. To assure stability, the base must be heavily weighted. When however, the lantern is very long, the single-legged support becomes insecure; for should one accidentally bump into the lantern, the leg then acts as a lever to tip over the base.

SUMMARY OF INVENTION

In view of the foregoing, the main object of this invention is to provide a lampstand adapted to support in a fully expanded state a collapsible oriental lantern.

More particularly, an object of this invention is to provide a lampstand of the above type which is operable with any member of a family of oriental lanterns which differ in length and which have end openings of different size. Thus, the same lampstand structure may be used with diverse oriental lanterns, thereby dispensing with the need to tailor a special lampstand for each lantern.

Also an object of the invention is to provide a lampstand which is readily assembled or dismantled, and which when erected is highly stable.

A significant feature of the invention is that the lampstand is of the knock-down type and makes use of components which can be housed in a shallow box also serving to contain the collapsed lantern to provide a highly compact package for storage and shipment.

Briefly stated, these objects are attained by a lampstand adapted to support in a fully expanded state a collapsible oriental lantern formed by an open-ended translucent sheel on a floor or table surface. The upper opening of the shell is bounded by a top rib to which is attached a spider whose center hub has a hole therein, the lower opening being bounded by a bottom rib provided with tie strings or other leg connectors. The stand includes a raised mounting plate supporting a lamp socket and a harp from which upwardly extends a vertical rod that passes through the hole in the spider hub. The rod has an elastic collar thereon which is axially shiftable to a point under the hub to maintain the upper end of the lantern at this level, which print depends on the length of the lantern. Depending from the mounting plate is an array of legs each having an outwardly sloped upper section and a straight lower section whose foot rests on the surface. The bottom rib of the lantern rests on the sloped upper section of the legs at a level thereon determined by the size of the lower opening of the lantern and is secured thereto by the leg connectors.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a first embodiment of a lampstand in accordance with the invention, for supporting an oriental lantern;

FIG. 2 is the same as FIG. 1, but in which the lantern is raised above the stand to expose its components;

FIG. 3 is a top view of the lantern;

Figure 12:
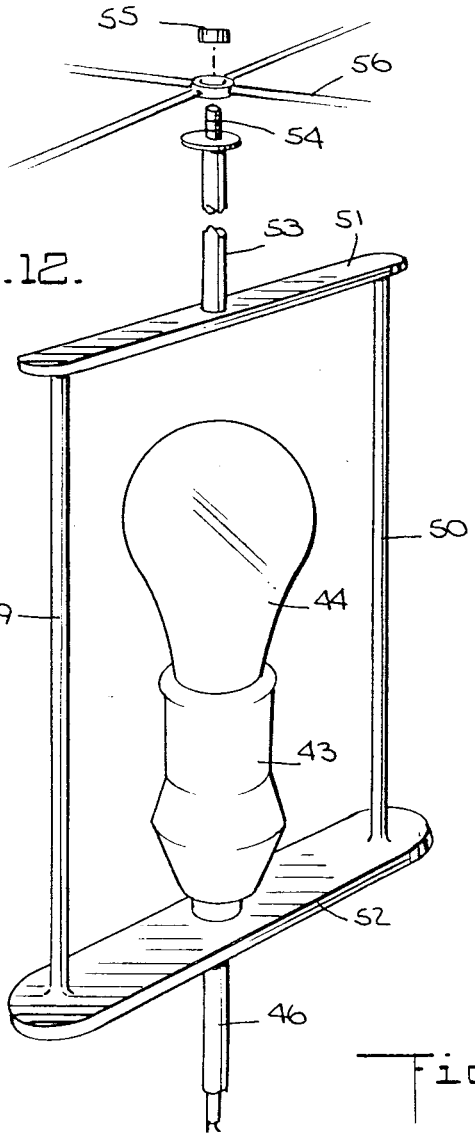
Figure 11:
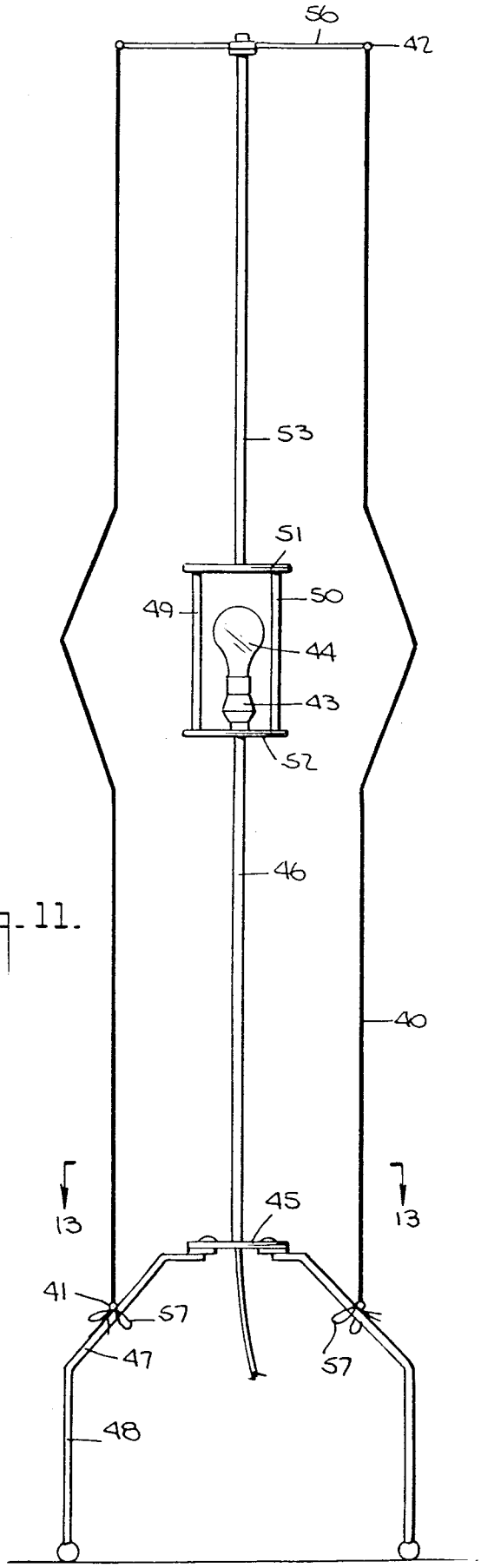
FIG. 11 is a longitudinal section taken in the plane indicated by line 11—11 in FIG. 9.

FIG. 12 separately illustrates the lamp harp; and

Figure 13:
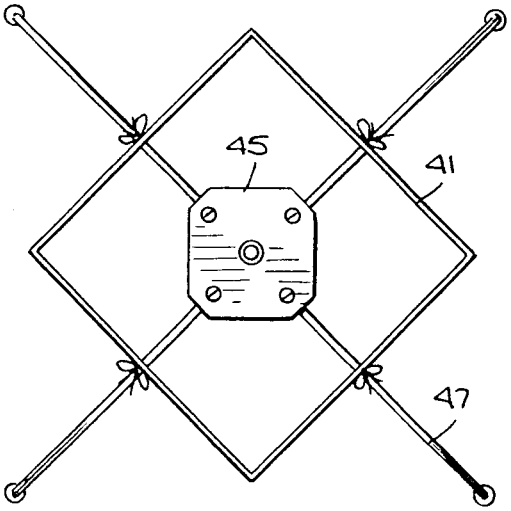

FIG. 13 is a transverse section taken in the plane indicated by line 13—13 in FIG. 1.

DETAILED DESCRIPTION

First Embodiment

Referring now to FIGS. 1 to 5, there is shown a lampstand in accordance with the invention for supporting in a fully expanded state a collapsible oriental lantern 10 having top and bottom circular openings. The lantern may be made of translucent rice paper, plastic film material or other suitable sheet or film, or fabric material.

As best seen in FIG. 3, the top opening is bordered by a circular reinforcing rib 11 which is concealed by the rice paper. Attached to the ribs are the radial arms 12, 13 and 14 of a metal spider whose hub 15 is provided with a center hole. The lower opening is bordered (see FIG. 4) by a circular rib 16 having three tie strings 17 connected thereto at equidistant positions, 120 degrees apart.

The lampstand includes a mounting plate 18 in the form of an equilateral triangle whose corners are truncated. Attached to the corners of mounting plate 18 and depending therefrom are three metal legs creating a tripod. Each leg has an outwardly sloped upper section 19 and a straight vertical section 20 terminating in a ball-shaped rubber foot 21.

Figure 7:
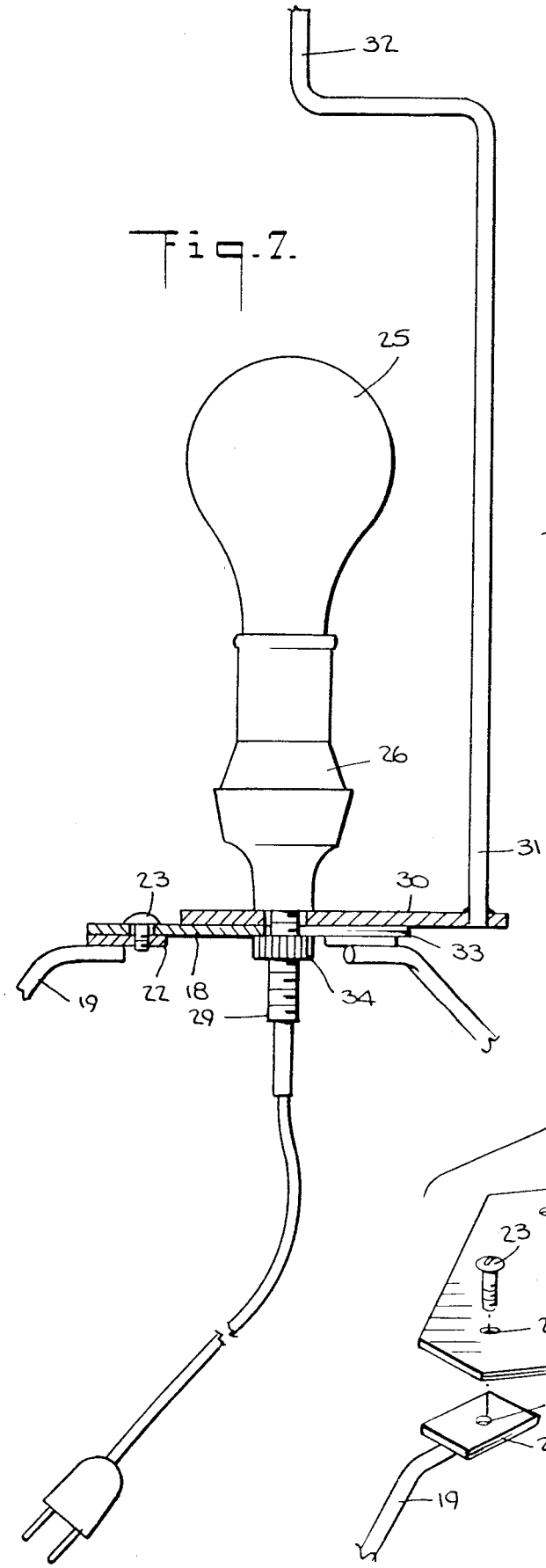
FIG. 7 is a section taken in the plane indicated by line 7—7 in FIG. 6.
Figure 6:
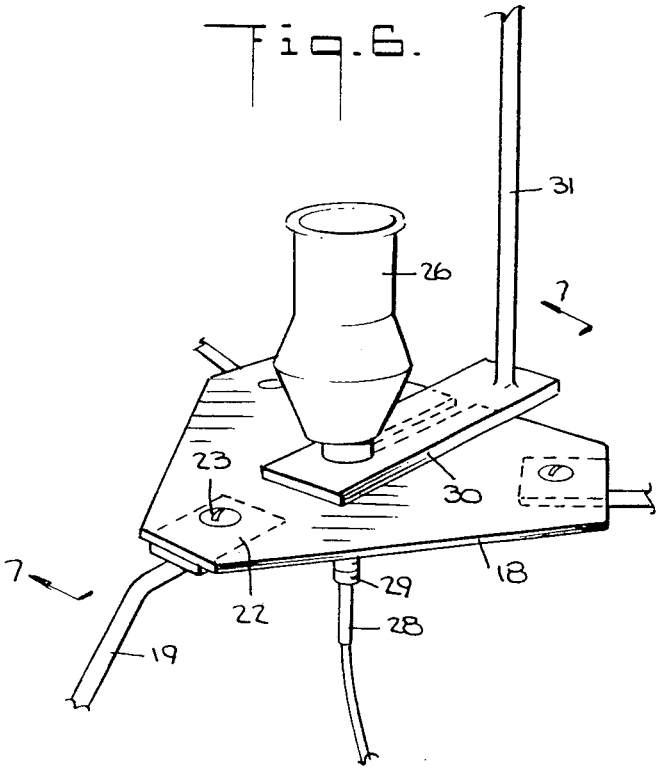
FIG. 6 is a perspective view of the mounting plate of the lampstand and of the bulb socket supported thereby.
Figure 8:
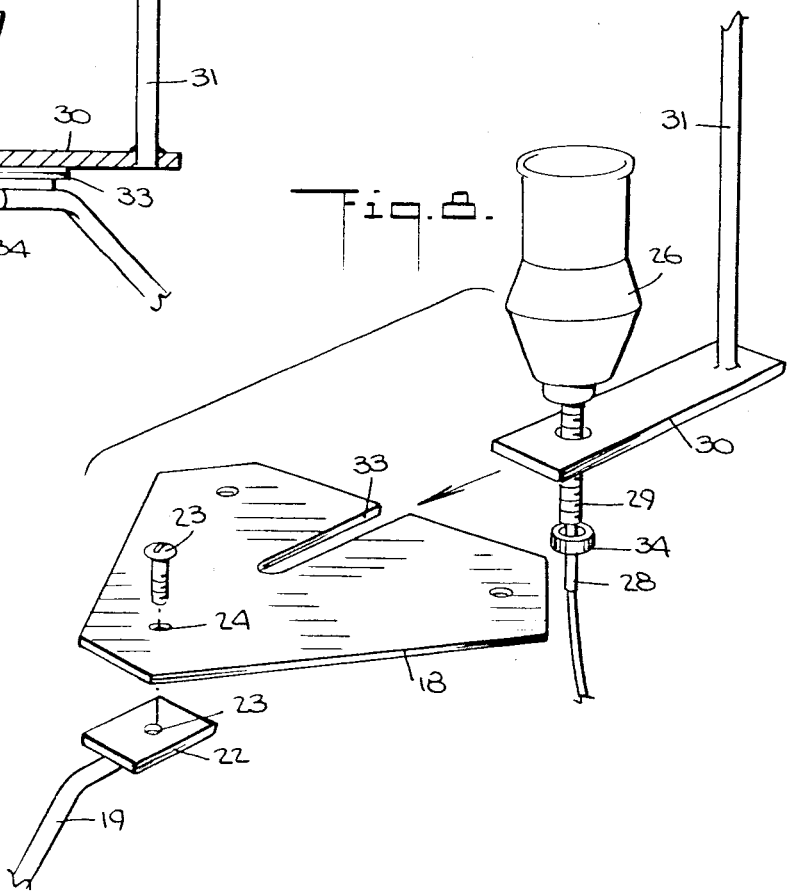
FIG. 8 illustrates how the bulb socket and the harp are joined to the mounting plate.
Figure 9:
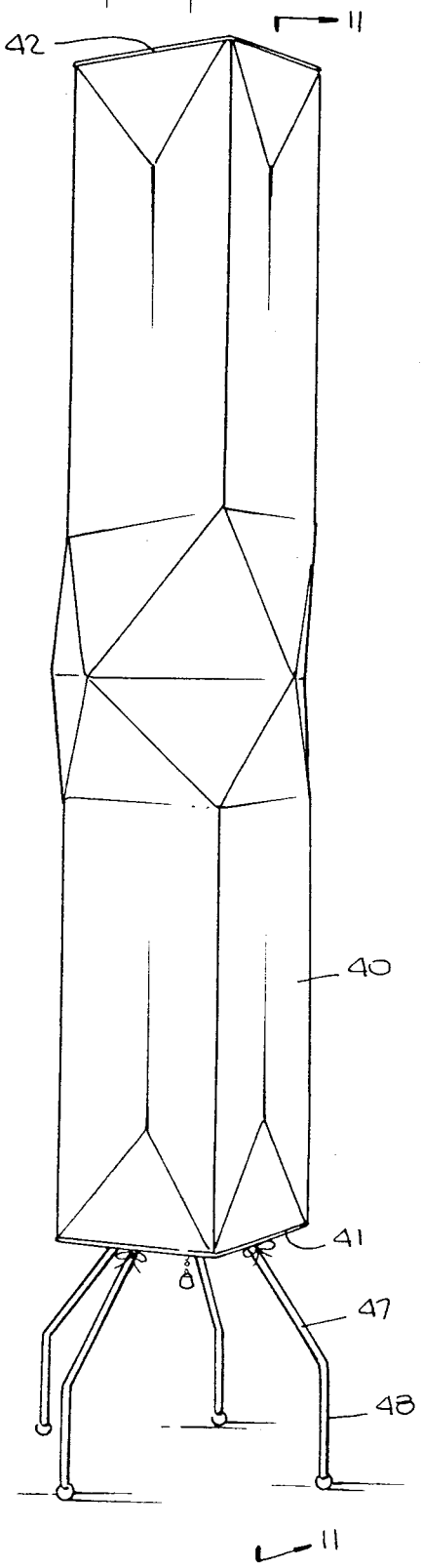
FIG. 9 is a second embodiment of a lampstand in accordance with the invention for supporting an exceptionally long oriental lantern.
Figure 10:
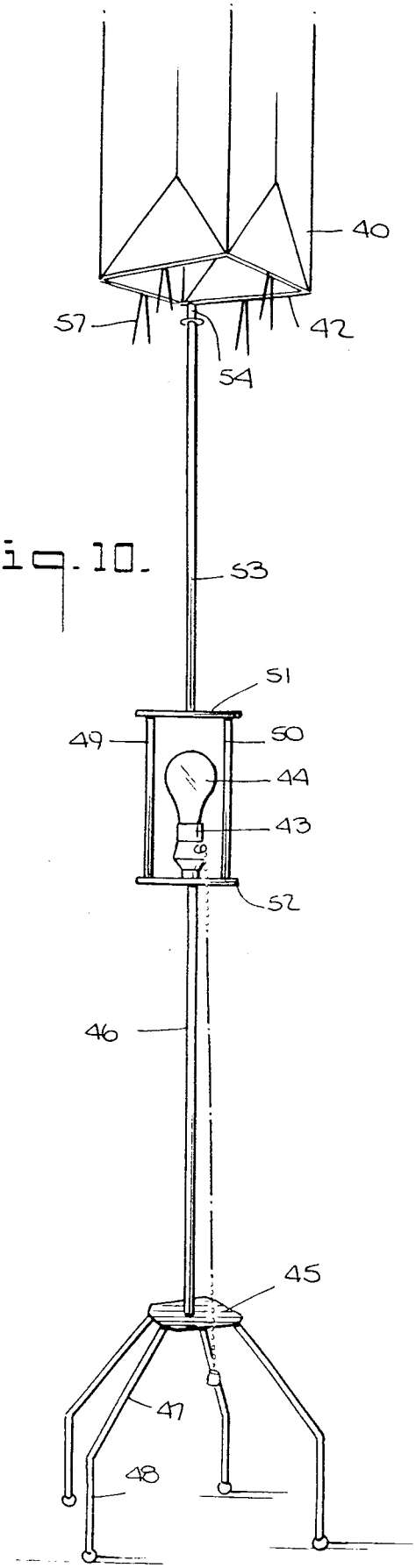
FIG. 10 shows the lantern raised above the stand.

As best seen in FIGS. 6, 7 and 8, to facilitate connection to mounting plate 18, the bent upper end of each leg is welded to a small rectangular lug 22 having a threaded hole which receives a screw 23 that passes through a bore 24 in the mounting plate.

A light bulb 25 is received in a standard bulb socket 26 having an internal switch operated by a pull chain 27. The power cable 28 for the socket goes through an externally-threaded short pipe 29 whose end is threadably received in the base of socket 26. Pipe 29 extends through a bore in a metal mounting strip 30 on which is anchored a one-legged harp 31, the harp being integral with a vertical extension rod 32.

To support the lamp socket 26 and the harp on mounting plate 18, the pipe 29 projecting axially below the socket is laterally inserted into a slot 33 in the mounting plate, with strip 30 lying on the top surface of the plate. When rod 29 is fully inserted in slot 33, the lamp socket is then centered on the mounting plate. A circular nut 34 received on pipe 29 acts to tighten the lamp socket and the harp strip in place.

Thus to assemble the lampstand is a simple procedure; for all that is necessary is to attach the legs to the mounting plate with a screw driver and then attach the lamp socket and the harp mounting strip to the mounting plate, using a pliers on nut 34 to tighten these elements in place. In the unassembled state, the mounting plate, the legs, the lamp socket and the harp may be placed flat in a shallow box which can also contain the collapsed lantern to provide a relatively compact package for storage and equipment.

After the lampstand is erected, the lantern 10, as shown in FIG. 2, is brought down on the stand, with the extension rod 32 passing through the hole of the hub 15 of the spider in the upper end opening of the lantern. To hold the lantern in a fully expanded state, rod 32 is provided with an elastic collar 35 which embraces the rod and is axially shiftable thereon to a position lying under hub 15 to maintain the desired position of the spider.

The rib 16 rests on the upper section 19 of the legs at a position thereon that depends on the diameter size of the lower end opening of the lantern. Tie strings 17 are tied to the legs at this position to maintain the lantern in its fully expanded state. In practice, other forms of leg connectors may be used, such as clips.

Figure 4:
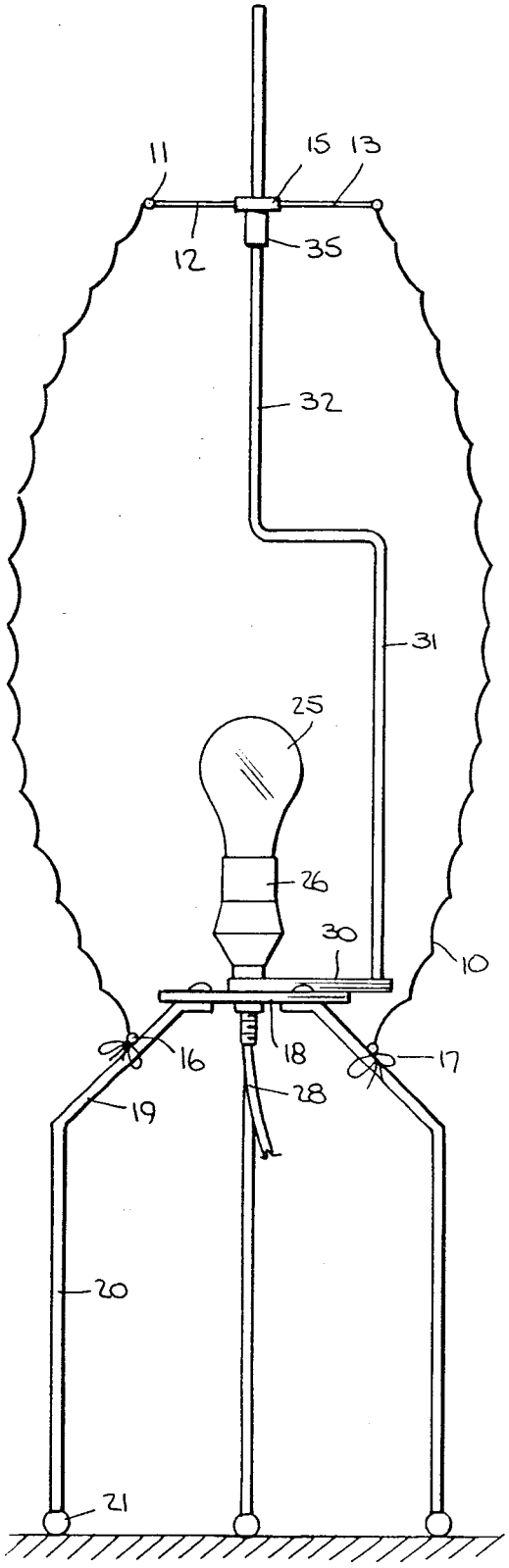
FIG. 4 is a section taken in the longitudinal plane indicated by line 4—4 in FIG. 1.
Figure 5:
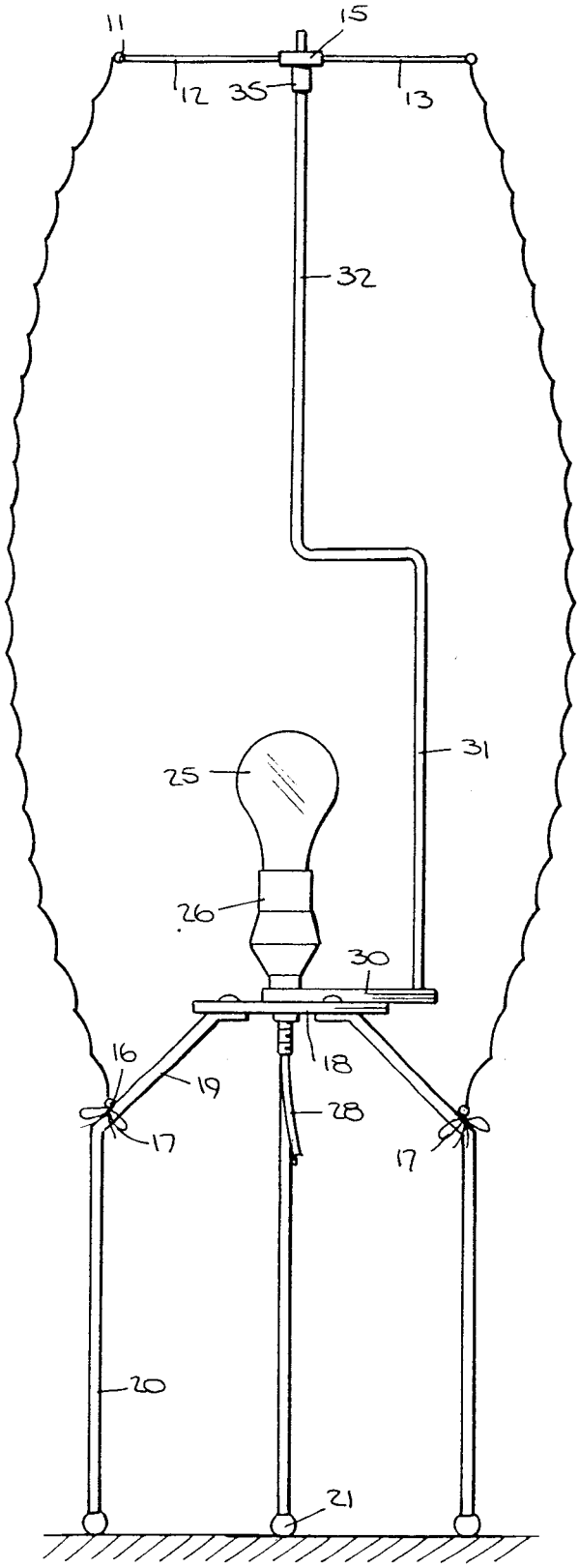
FIG. 5 is the same as FIG. 4 but with a lantern of different length and with end openings of larger size.

Thus in the case of lantern 10 shown in FIG. 4, which is shorter than lantern 10' shown in FIG. 5 and has a lower end opening of smaller diameter, tie strings 17 are connected to the upper section 19 of the legs at about their midpoint, and the lantern, when fully expanded, has its upper end opening well below the upper end of extension rod 32, it being held at this position by collar 35. In the case of lantern 10', the tie strings 17 at the lower end opening of the lantern are close to the lower ends of upper leg sections 29, whereas the upper end opening is close to the upper end of the extension rod.

Thus the same lampstand may be used for lanterns of different length and having different size end openings. To remove the lantern from the lampstand, one has only to untie the tie strings for then it is possible by holding the lantern by its lower rib to raise it above the lampstand and in doing so, collapse the structure.

Second Embodiment

As shown in FIGS. 9 to 13, the second embodiment of the stand is designed to support an unusually long collapsible oriental lantern 40 having a square cross section except for an enlarged multi-faceted mid-section. The upper and lower end openings are bordered in this instance by square ribs 41 and 42.

In this instance, the lamp socket 43 which receives bulb 44 is elevated above the mounting plate 45 to occupy a position within the mid-section of the lantern. This is effected by means of a hollow pole 46 whose lower end is threaded and is received in a threaded center hole in mounting plate 45, the power cable for the lamp going through this pole.

Mounting plate 45 is square with truncated corners from which depend legs similar to those in the first embodiment and having a sloped upper section 47 and a straight lower section 48 to provide a stable four-legged support for the lantern.

The harp in this instance lies within the midsection of the lantern and is formed by a pair of posts 49 and 50 joined together by upper and lower cross pieces 51 and 52. The threaded upper end of pole 46 passes through a hole in cross piece 52 into the base of socket 43.

An extension rod 53 in line with pole 46 is anchored in cross piece 51 of the harp and terminates in a threaded stud 54 having an enlarged disc-shaped base 54. This stud is received in the center hole of the hub 55 of a spider whose radial arms 56 are joined to the upper end opening rib 42 of the lantern. A nut 55 received on stud 54 acts to tighten the spider connection to the extension rod. In practice, instead of the screw and nut, use may be made of an élastic collar on the extension rod.

Four tie strings 57 attached to the lower rib 41 serve to join the lower end of the lantern to the sloped upper section 47 of the legs at a position thereon which depends on the size of the lower end opening of the lantern.

This lampstand is not limited to the particular lantern shown and is usable with many other configurations. Where the lantern has a square rather than circular end openings, then a four-legged stand is appropriate, one for each side. But the tie string principle is the same.

This stand is also easily assembled by first attaching the legs to the mounting plate 45, then attaching the lamp harp to the mounting plate by means of pole 46, and attaching the extension rod 53 to the harp.

While there has been shown and described preferred embodiments of LANTERN TYPE ELECTRIC LAMP in accordance with the invention, it will be appreciated that many changes and modifications may be made therein without, however, departing from the essential spirit thereof.

I claim:

1. In combination with a collapsible oriental lantern, a lampstand supporting in a fully expanded state said collapsible oriental lantern which is formed by an open-ended translucent shell whose upper opening is bordered by atop rib and whose lower opening is bordered by a spiderless bottom rib which does not obstruct the lower opening, a spider having a central hub provided with a hole being attached by its radial arms to the top rib, leg connectors being attached to the bottom rib, said lantern when fully expanded having a predetermined length, said lampstand comprising:

(A) a raised mounting plate from which depends an array of like legs, each having an outwardly sloped upper section and a straight lower section whose foot is restable on a floor or table surface;

(B) a lamp socket and a harp associated therewith supported above the mounting plate;

(C) a vertical rod extending above the harp and passing through the hole in the hub;

(D) means to hold said hub on said rod at a position at which the lantern is fully expanded and said spiderless bottom rib rests on said upper leg sections at a position determined by its length, whereby the same lampstand may be used for lanterns of different lengths, said position being maintained by attaching said bottom rib to the said upper leg sections with said leg connectors.

2. The combination as set forth in claim 1, wherein said leg connectors are constituted by tie strings which are joined to the bottom rib and are tied to said upper leg section.

3. The combination as set forth in claim 1, wherein said mounting plate is in triangular form having truncated corners to which three legs are attached.

4. The combination as set forth in claim 3, wherein each leg has a flat lug attached to its upper end and having a threaded bore to receive a screw passing through a hole in the plate.

5. The combination as set forth in claim 4, wherein said harp is constituted by a single leg whose upper end is provided with an integral extension forming said extension rod.

6. The combination as set forth in claim 1, wherein said means to hold the hub on said rod is formed by an elastic collar shiftable on said rod.

7. The combination as set forth in claim 1, wherein said harp is formed by a pair of parallel posts joined at either end by cross pieces, the lower cross piece being connected at its midpoint to a hollow pole anchored on said mounting plate, the upper cross piece having said extension rod anchored at its midpoint.

8. The combination as set forth in claim 7 wherein said plate has four corners to which four legs are attached.

9. The combination as set forth in claim 8 wherein said lantern has square end openings and said bottom rib is square and has four leg connectors attached thereto.

* * * * *